US008656530B2

(12) United States Patent
You et al.

(10) Patent No.: US 8,656,530 B2
(45) Date of Patent: Feb. 25, 2014

(54) ADJUSTABLE MECHANISM FOR CHANGING FLOOR HEIGHT OF A PLAY YARD

(75) Inventors: Youn-Fu You, Chang Hua (TW); Ho-Sheng Chen, Chiayi County (TW); Ching-Hsing Kuo, Tainan (TW)

(73) Assignee: Lerado (Zhong Shan) Industrial Co., Ltd., Zhong Shan, Guang Dong Province (CN)

( * ) Notice: Subject to any disclaimer, the term of this patent is extended or adjusted under 35 U.S.C. 154(b) by 4 days.

(21) Appl. No.: 13/396,342

(22) Filed: Feb. 14, 2012

(65) Prior Publication Data

US 2012/0211713 A1 Aug. 23, 2012

(30) Foreign Application Priority Data

Feb. 22, 2011 (CN) ..... 2011 2 0044171 U

(51) Int. Cl.
*A47D 7/00* (2006.01)
*A47D 13/06* (2006.01)

(52) U.S. Cl.
USPC ..... 5/93.2; 5/98.1; 5/99.1

(58) Field of Classification Search
USPC ..... 5/93.1, 93.2, 98.1, 99.1
See application file for complete search history.

(56) References Cited

U.S. PATENT DOCUMENTS

| | | | | | |
|---|---|---|---|---|---|
| 5,163,191 | A * | 11/1992 | Chan | ..... | 5/98.1 |
| 5,339,470 | A * | 8/1994 | Shamie | ..... | 5/98.1 |
| 5,349,709 | A * | 9/1994 | Cheng | ..... | 5/93.1 |
| 6,058,528 | A * | 5/2000 | Yang | ..... | 5/93.1 |
| 6,131,218 | A * | 10/2000 | Wang | ..... | 5/93.1 |
| 6,430,762 | B1 * | 8/2002 | Cheng | ..... | 5/93.2 |
| 7,055,191 | B1 * | 6/2006 | Chen | ..... | 5/93.2 |
| 7,543,342 | B2 * | 6/2009 | Zhao et al. | ..... | 5/93.1 |
| 2005/0144716 | A1 * | 7/2005 | Chen | ..... | 5/93.1 |

* cited by examiner

*Primary Examiner* — Michael Trettel
(74) *Attorney, Agent, or Firm* — Muncy, Geissler, Olds & Lowe P.C.

(57) ABSTRACT

The adjustable mechanism for changing floor height of a play yard according to the present invention comprises at least a foldable frame, a first bed floor, a flexible envelope and an adjustable mechanism. The foldable frame has an upper border portion and a base support assembly. The first bed floor is connected to the base support assembly. The flexible envelope has a second bed floor and a shading periphery connected with the second bed floor, the shading periphery is folded to form an indigitation length exposed outside the foldable frame thereby adjustably hanging on the upper border portion. The adjustable mechanism is operatively mounted on the foldable frame and connected with the lower end of the indigitation length for adjusting the second bed floor relative to the first bed floor in distance and height.

14 Claims, 7 Drawing Sheets

ADJUSTABLE MECHANISM FOR CHANGING FLOOR HEIGHT OF A PLAY YARD

BACKGROUND OF THE INVENTION

1. Field of the Invention

The present invention relates generally to an adjustable mechanism for a play yard; more particularly, to a play yard with an adjustable second floor and adjustable mechanism.

2. Description of the Related Art

Traditional play yard provides a fixed base floor which can support an occupant such as baby or little child to play and sleep thereon. Due to it is too deep, while the little occupant is slept within the play yard, it would not be easy to the care-giver to hold it up for changing diaper.

Toys and diapers are important daily needs for caring a baby. When lack of sufficient storage space around the play yard, the care-giver may tend to put those stuffs inside the play yard, and thus would shrink the accommodating space for the little occupant to stay in the play yard.

SUMMARY OF THE INVENTION

To solve the mentioned problems, the present invention provides an adjustable mechanism for changing floor height of a play yard, comprising at least a foldable frame, a first bed floor, a flexible envelope and an adjustable mechanism. The foldable frame has an upper border portion and a base support assembly. The first bed floor is connected to the base support assembly.

The flexible envelope has a second bed floor and a shading periphery connected with the second bed floor, the shading periphery is folded to form an indigitation length exposed outside the foldable frame thereby adjustably hanging on the upper border portion. The adjustable mechanism is operatively mounted on the foldable frame and connected with the lower end of the indigitation length. By manipulating the adjustable mechanism, could permit the care-giver to extend or reduce the indigitation length so as to adjust the height of the second bed floor relative to the first bed floor in distance and height.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention; examples of which are illustrated in the accompanying drawings.

Figure 1:
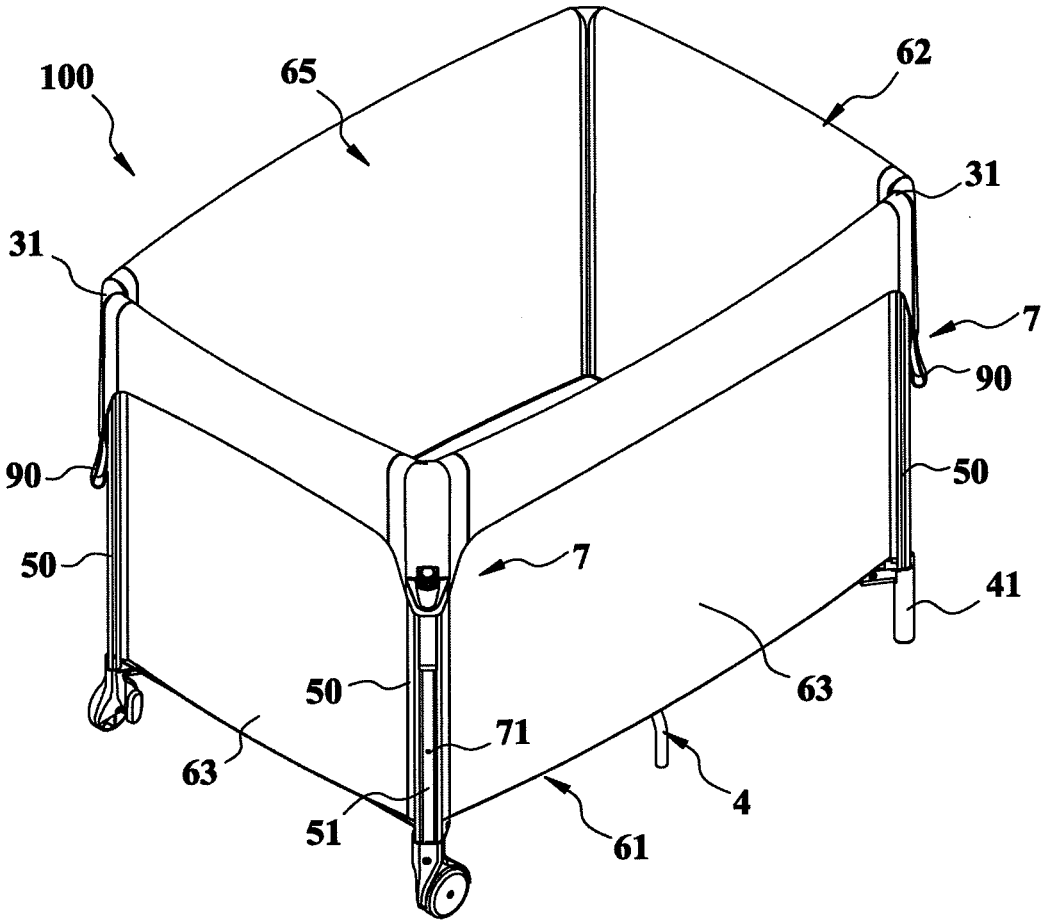
FIG. 1 is a perspective view showing an embodiment of the adjustable mechanism for changing floor height of a play yard according to the present invention.
Figure 2:
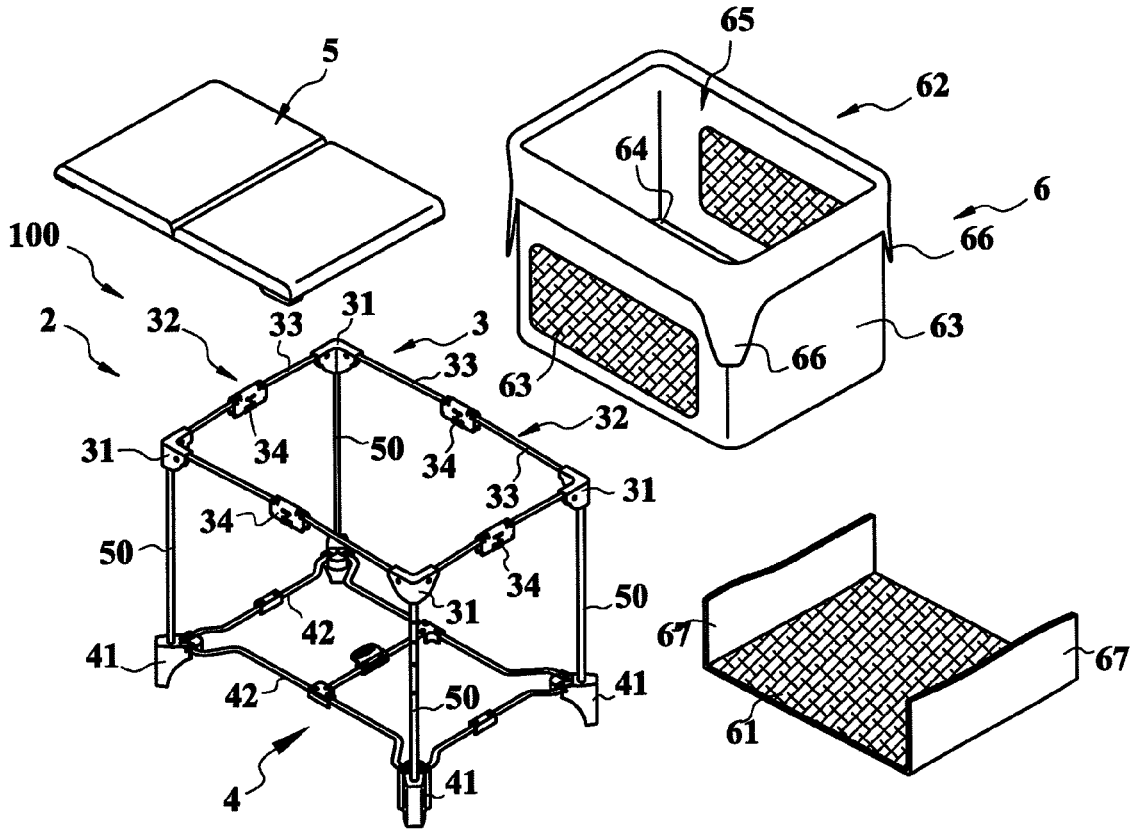
FIG. 2 is an exploded view showing the adjustable mechanism and the play yard of the embodiment.

Referring to FIGS. 1 and 2, a preferred embodiment of the adjustable mechanism for changing floor height of a play yard according to the present invention, comprises at least a foldable frame 2, a first bed floor 61, a flexible envelope 6 and an adjustable mechanism 7.

Figure 6:
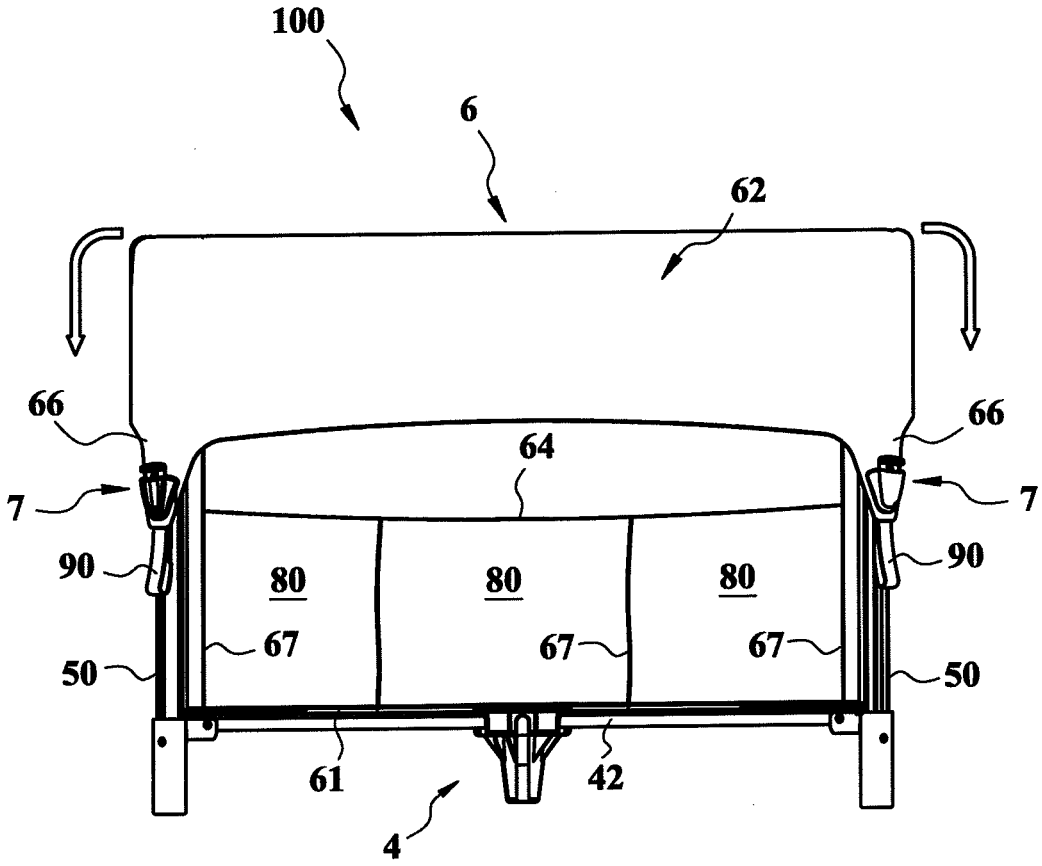
FIG. 6 is a schematic side view showing the operation of adjusting the second floor height.
Figure 7:
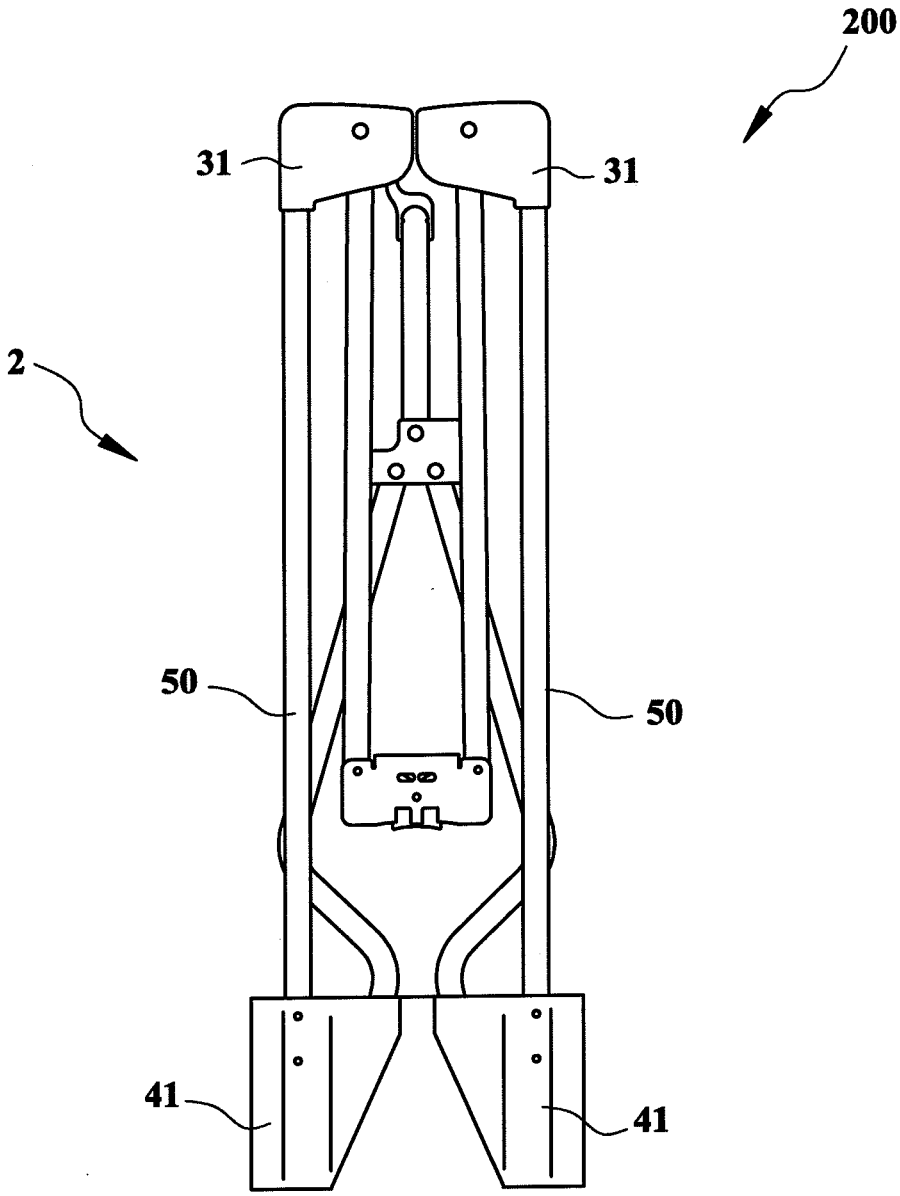
FIG. 7 is a schematic side view showing the play yard transformed into a folded position.

The foldable frame 2 has an upper border portion 3 and a base support assembly 4. The foldable frame 2 may further include a plurality of vertical struts 50 pivoted with the upper border portion 3 and the base support assembly 4 that permits the foldable frame 2 to be kept in an erecting position 100 as shown in FIG. 6 and a folded position 200 as shown in FIG. 7.

The upper border portion 3 may include a plurality of foldable mechanism 32 and upper pivotal mounts 31, each comprises a pair of rails 33 connected between a lockable joint 34 and the upper pivotal mounts 31. The base support assembly 4 may include a plurality of support rails 42 pivoted between a plurality of lower pivot mounts 41. In this embodiment, the vertical struts 50 are used to pivot between the upper pivotal mounts 31 and the lower pivot mounts 41.

The first bed floor 61 is connected to and support by the base support assembly 4. Referring to FIG. 2, the first bed floor 61 may include at least a vertical flap 67 connected to the underside of the shading periphery 62 for forming a storing space 80 between the first bed floor 61 and the second bed floor 64. Referring to FIG. 6, preferably the first bed floor 61 may include a plurality of vertical flaps 67 connected to the underside of second bed floor 64 for forming a plurality of storing spaces 80 between the first bed floor 61 and the second bed floor 64.

Figure 5:
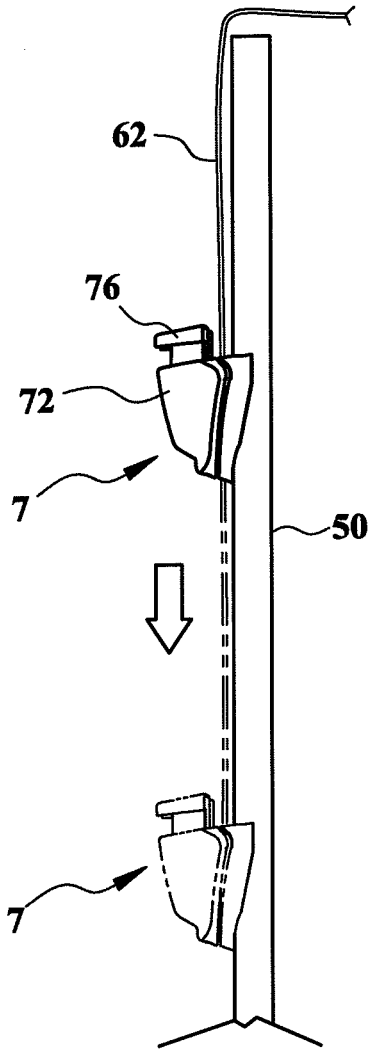
FIG. 5 is a schematic view showing the operation of the adjustable mechanism.

The flexible envelope 6 includes a second bed floor 64 and a shading periphery 62 connected with the second bed floor 64. As shown in FIGS. 2, 5 and 6, the shading periphery 62 is folded to form an indigitation length 66 which exposed outside of the foldable frame 2 thereby adjustably hanging on the upper border portion 3 of the foldable frame 2.

The flexible envelope 6 may be made of fabric or plastic material and formed with a plurality of side shading portions 63 and an accommodating space 65. The flexible envelope 6 may further include a pad 5 for paving on the second bed floor 64, so as to support a baby or little child occupant to stay thereon. Preferably, as shown in FIG. 2, the pad 5 may made of separated wood plates and foams, covered with a layer of fabric or plastic to construct a foldable structure, which can be transformed into a small configuration.

Figure 3:
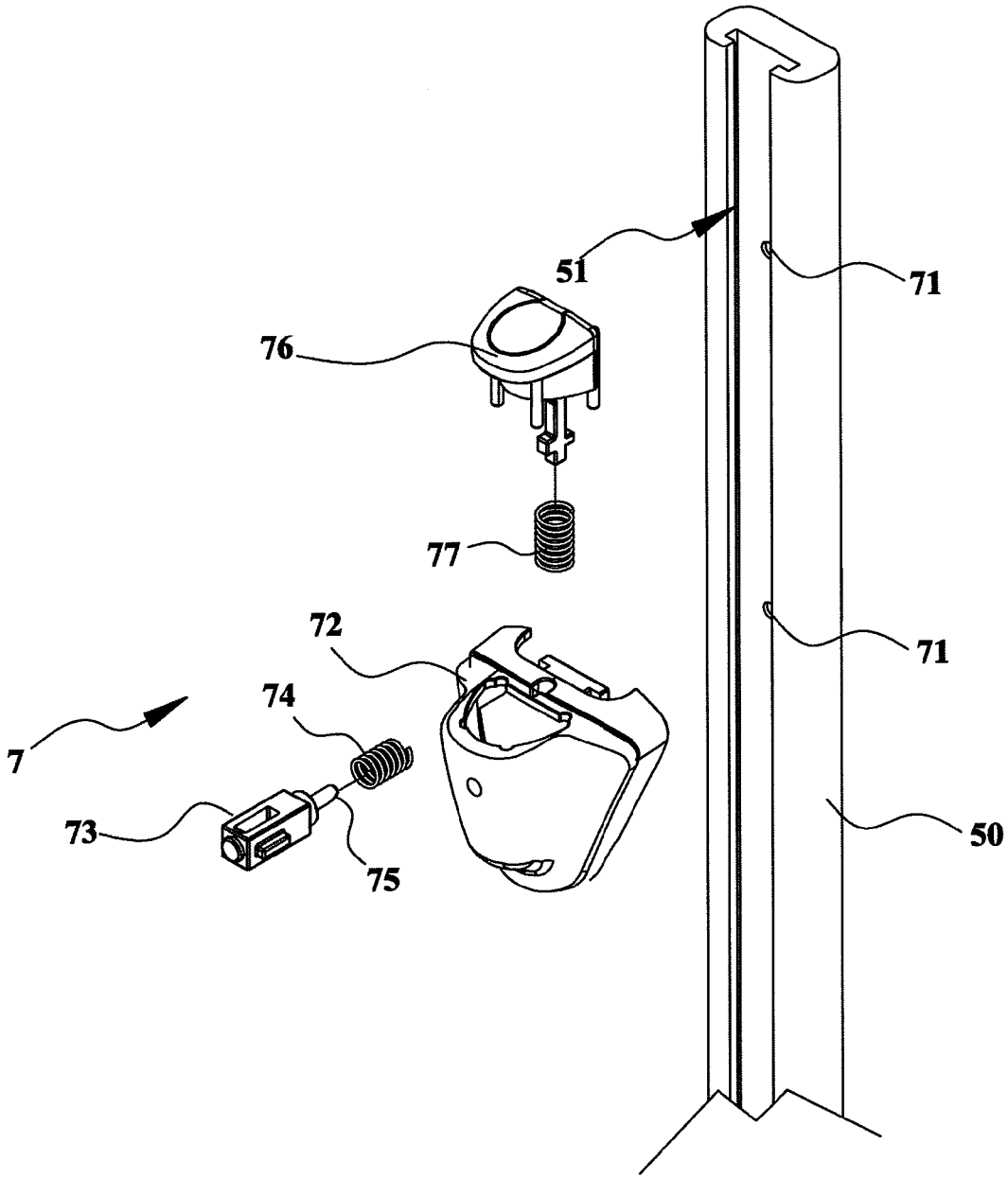
FIG. 3 is a schematic exploded view showing an adjustable mechanism of the embodiment.
Figure 4:
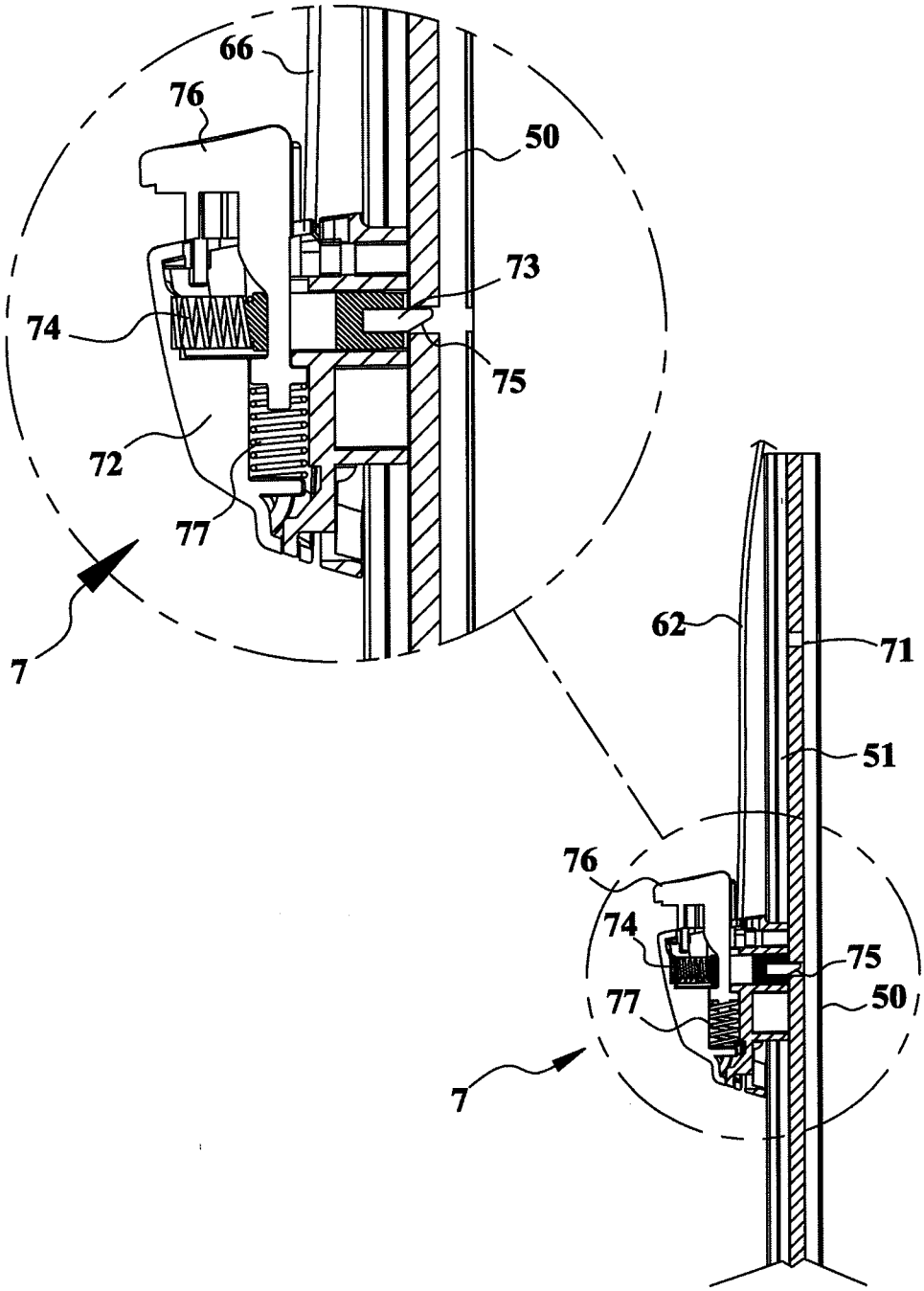
FIG. 4 is a cross-sectional view showing the adjustable mechanism of the embodiment.

Referring to FIGS. 1, 3 and 4, the vertical struts 50 each has a plurality of positioning portions 71 for keeping the adjustable mechanism 7 in a selected position. By this way, to fix the length of the indigitation length 66 and the height of the second bed floor 64.

The adjustable mechanism 7 is operatively mounted on the foldable frame 2. The adjustable mechanism 7 connects with the indigitation length 66 for adjusting the second bed floor 64 relative to the first bed floor 61 in distance and height.

Referring to FIGS. 3 to 5, the adjustable mechanism 7 may comprise a sliding carrier 72, a spring-biased locking element 73 and a release actuator 76.

The sliding carrier 72 may connect with a corner of the flexible envelope 6 and capable of moving along the vertical struts 50 for adjusting the indigitation length 66 and the second bed floor 64. Preferably, the vertical struts 50 each may be formed with a guiding slot 51 for guiding the moving of the sliding carrier 72. In this embodiment, the positioning portions 71 may be embodied as a plurality of holes formed within the guiding slot 51 used for engaging with the spring-biased locking element 73.

The spring-biased locking element 73 is operatively connected with the sliding carrier 72 for engaging with one of the positioning portions 71. The spring-biased locking element 73 is biased toward the positioning portions 71 by a resilient element 74. Preferably, the spring-biased locking element 73 may formed with a slanting end face 75 that permits the sliding carrier 72 to move downward without retracting the spring-biased locking element 73 by manipulating the release actuator 76.

Referring to FIGS. 3 to 5, the release actuator 76 is associated with the spring-biased locking element 73 for disengaging the spring-biased locking element 73 from the positioning portions 71. The release actuator 76 may be retractably received in the sliding carrier 72 and biased by a resilient element 77. Preferably, the release actuator 76 may further include a button for driving the spring-biased locking element 73 by pressing thereon.

Referring to FIG. 1, the flexible envelope 6 may include a plurality of pulling elements 90. By pulling the pulling elements 90, the care-giver can extend the indigitation length 66 so as to lift the second bed floor 64 to increase the distance relative to the first bed floor 61.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. An adjustable mechanism for changing floor height of a play yard, comprising:

a foldable frame, having an upper border portion and a base support assembly;

a first bed floor, connected to the base support assembly;

a flexible envelope, having a second bed floor and a shading periphery connected with the second bed floor, the shading periphery being folded to form an indigitation length for adjustably hanging on the upper border portion; and an adjustable mechanism for adjusting the indigitation length of the flexible envelope, the second bed floor being adjusted relative to the first bed floor in distance and height, wherein the first bed floor has at least a vertical flap connected to the shading periphery for forming a storing space between the first bed floor and the second bed floor.

2. The adjustable mechanism for changing a floor height of a play yard of claim 1, wherein the foldable frame includes a plurality of vertical struts pivoted with the upper border portion and the base support assembly that permits the foldable frame to be kept in an erected position and a folded position.

3. The adjustable mechanism for changing floor height of a play yard of claim 1, wherein the first bed floor has a plurality of vertical flaps connected to the second bed floor for forming a plurality of storing spaces between the first bed floor and the second bed floor.

4. The adjustable mechanism for changing floor height of a play yard of claim 1, wherein the flexible envelope includes a pad for paving on the second bed floor.

5. The adjustable mechanism for changing floor height of a play yard of claim 4, wherein the pad is foldable.

6. The adjustable mechanism for changing floor height of a play yard of claim 2, wherein the plurality of vertical struts each has a plurality of positioning portions for keeping the adjustable mechanism in a selected position, thereby fixing the second bed floor at a height.

7. The adjustable mechanism for changing floor height of a play yard of claim 6, wherein the adjustable mechanism further comprises:

a sliding carrier connected with a corner of the flexible envelope and capable of moving along the plurality of vertical struts, thereby adjusting the indigitation length and the second bed floor;

a spring-biased locking element operatively connected with the sliding carrier for engaging with one of the plurality of positioning portions; and a release actuator associated with the spring-biased locking element for disengaging the spring-biased locking element from the positioning portions.

8. The adjustable mechanism for changing floor height of a play yard of claim 7, wherein the spring-biased locking element has a slanting end face that permits the sliding carrier to move downward without manipulating the release actuator.

9. The adjustable mechanism for changing floor height of a play yard of claim 6, wherein the flexible envelope has a plurality of pulling elements for pulling the indigitation length downward, thereby lifting the second bed floor upward.

10. The adjustable mechanism for changing floor height of a play yard of claim 7, wherein each of the plurality of vertical struts is formed with a guiding slot for guiding the sliding carrier.

11. The adjustable mechanism for changing floor height of a play yard of claim 10, wherein the plurality of positioning portions include a plurality of holes formed within the guiding slot for engaging with the spring-biased locking element.

12. The adjustable mechanism for changing floor height of a play yard of claim 7, wherein the release actuator includes a button for driving the spring-biased locking element.

13. The adjustable mechanism for changing floor height of a play yard of claim 7, wherein the release actuator is retractably received in the sliding carrier and biased by a resilient element.

14. The adjustable mechanism for changing floor height of a play yard of claim 7, wherein the spring-biased locking element is biased toward the positioning portions by a resilient element.

* * * * *